US011160365B2

(12) United States Patent
Tao et al.

(10) Patent No.: US 11,160,365 B2
(45) Date of Patent: Nov. 2, 2021

(54) SYNCHRONIZING LIFTER AND LIFTING TABLE

(71) Applicant: JIANGSU JELT LIFTING SYSTEM CO., LTD., Changzhou (CN)

(72) Inventors: Shengrong Tao, Changzhou (CN); Xiaogang Li, Changzhou (CN)

(73) Assignee: JIANGSU JELT LIFTING SYSTEM CO., LTD., Changzhou (CN)

( * ) Notice: Subject to any disclaimer, the term of this patent is extended or adjusted under 35 U.S.C. 154(b) by 8 days.

(21) Appl. No.: 16/834,966

(22) Filed: Mar. 30, 2020

(65) Prior Publication Data

US 2020/0329862 A1 Oct. 22, 2020

(30) Foreign Application Priority Data

Apr. 16, 2019 (CN) ..... 201910302399.1

(51) Int. Cl.
*A47B 9/12* (2006.01)

(52) U.S. Cl.
CPC ..... *A47B 9/12* (2013.01); *A47B 2200/005* (2013.01)

(58) Field of Classification Search
CPC .... A47B 9/16; A47B 9/10; A47B 9/12; A47B 9/14; A47B 9/20; A47B 9/00; A47B 21/02; A47B 2200/0061; A47B 2200/005; A47B 2200/0051; A47B 2200/0056
USPC ..... 108/147, 20
See application file for complete search history.

(56) References Cited

U.S. PATENT DOCUMENTS

| | | | | |
|---|---|---|---|---|
| 9,038,549 | B1 * | 5/2015 | Zebarjad | A47B 9/02 108/147 |
| 9,504,315 | B2 * | 11/2016 | Hansen | A47B 9/10 |
| 10,905,232 | B2 * | 2/2021 | Verhappen | A47B 9/12 |
| 10,952,531 | B2 * | 3/2021 | Franz | A47B 9/06 |
| 11,019,919 | B2 * | 6/2021 | Tao | A47B 9/20 |
| 2016/0227921 | A1 * | 8/2016 | Hansen | A47B 9/02 |
| 2017/0000256 | A1 * | 1/2017 | Zebarjad | A47B 9/02 |
| 2020/0121072 | A1 * | 4/2020 | Tao | A47B 9/12 |

FOREIGN PATENT DOCUMENTS

| | | |
|---|---|---|
| CN | 108703495 | * 10/2018 |
| CN | 108903242 | * 11/2018 |
| CN | 209017982 | * 6/2019 |

(Continued)

*Primary Examiner* — Janet M Wilkens
(74) *Attorney, Agent, or Firm* — Bayramoglu Law Offices LLC

(57) ABSTRACT

A synchronizing lifter and a lifting table are disclosed that can ensure components supported on the synchronizing lifter cannot be in an inclined state. This has advantages in that by releasing the locking of one of power output portions of a linear driver, a first flexible traction component, a second flexible traction component, a first bracket and a second bracket through a locking mechanism, the driver works and a flexible connection component connected to the output end of the driver can move. The power is transferred to a corresponding bracket that drives a power transfer component to move up or down. The power transfer component drives the other bracket to move up or down, and another bracket drives the other flexible traction component to move. One driver drives the two ends of a synchronizing mechanism to move up and down, so that the structure is simple and costs are kept low.

16 Claims, 9 Drawing Sheets

(56) References Cited

FOREIGN PATENT DOCUMENTS

| | | | |
|---|---|---|---|
| CN | 110056593 | * | 7/2019 |
| CN | 111109841 | * | 5/2020 |
| DE | 202019105475 | * | 10/2019 |
| EP | 2250925 | * | 11/2010 |
| EP | 3626123 | * | 3/2020 |
| KR | 20200005678 | * | 1/2020 |

* cited by examiner

SYNCHRONIZING LIFTER AND LIFTING TABLE

TECHNICAL FIELD

The present invention relates to a synchronizing lifter and a lifting table.

BACKGROUND ART

As a daily necessity, a table is often used in life, work and schools. A common table is usually formed by fixedly connecting a tabletop with table legs. Because the length of each table leg is fixed, the height of the whole tabletop is fixed and cannot be adjusted. With the different application environments and the application requirements of different people, the requirements for the height diversification, degree of automation and degree of comfort of the table are higher and higher.

In the prior art, gas springs are used as the table legs of the table so as to support the tabletop, a control assembly for controlling the gas springs to be opened or closed is mounted on the lower surface of the tabletop, the control assembly is connected with a dragline connecting piece (the dragline connecting piece is hinged on a connecting assembly) on the connecting assembly through components such as a dragline, and the other end of the dragline connecting piece abuts against switches of the gas springs. When the table is required to be raised or lowered, a user controls the control assembly to transfer power to the dragline so as to enable the dragline connecting piece to rotate, and then, the switches of the gas springs are turned on, so that the gas springs are raised or lowered according to the intention of the user.

The table legs of the two ends of the table are all supported by the gas springs, so that when the table is controlled to ascend or descend, the gas springs need to operate synchronously, otherwise, one side is raised or lowered, but the other side is still in an original state, causing the tabletop to incline. For example, when it is necessary to lower the tabletop, a user applies a large pressing force to one end of the table and applies a small pressing force to the other end, which easily causes the tabletop to incline.

SUMMARY OF THE INVENTION

The present invention is directed to a synchronizing lifter and a lifting table. The present invention can ensure that components supported on the synchronizing lifter cannot be in an inclined state.

The technical solution for solving the above technical problem is as follows: A synchronizing lifter includes a first inner fixed tube and a second inner fixed tube and further includes a synchronizing mechanism, wherein the synchronizing mechanism includes a first bracket with one end being in clearance fit in the first inner fixed tube and a second bracket with one end being in clearance fit in the second inner fixed tube;

a power transfer component spanned between the first bracket and the second bracket, wherein one end of the power transfer component is connected with the other end of the first bracket, and the other end of the power transfer component is connected with the other end of the second bracket;

a first flexible traction component, wherein one end of the first flexible traction component is connected with the second inner fixed tube, the first flexible traction component is flexibly matched with one end of the second bracket, one end of the first bracket and the other end of the first bracket, and the other end of the first flexible traction component is connected with the first inner fixed tube;

a second flexible traction component, wherein one end of the second flexible traction component is connected with the first inner fixed tube, the second flexible traction component is flexibly matched with one end of the first bracket, one end of the second bracket and the other end of the second bracket, and the other end of the second flexible traction component is connected with the second inner fixed tube;

a linear driver, wherein a power output portion of the linear driver is connected with one of the first flexible traction component, the second flexible traction component, the first bracket and the second bracket;

a locking mechanism, wherein the locking mechanism is matched with the power output portion of the linear driver so as to limit the displacement of the output portion of the linear driver; or the locking mechanism is matched with one of the first flexible traction component and the second flexible traction component so as to limit the displacement of the first flexible traction component or the second flexible traction component; or the locking mechanism is matched with one of the first bracket and the second bracket so as to limit the displacement of the first bracket and the second bracket; and an unlocking mechanism for driving the locking mechanism to be separated from one of the linear driver, the first flexible traction component, the second flexible traction component, the first bracket and the second bracket, and the unlocking mechanism is connected with the locking mechanism.

The present invention has the advantages that by releasing the locking of one of the power output portion of the linear driver, the first flexible traction component, the second flexible traction component, the first bracket and the second bracket through the locking mechanism, the driver works, a flexible connection component connected to the output end of the driver can move, then, the power is transferred to the corresponding bracket, the bracket drives the power transfer component to move up or down, the power transfer component drives the other bracket to move up or down, and the other bracket drives the other flexible traction component to move. Therefore, the synchronizing lifter of the present invention ensures the lifting synchronization of two ends of a product, and in the product using process, the condition that the product inclines due to different lifting sizes of the two ends during lifting of the product can be avoided. The present invention is provided with one driver which can drive the two ends of the synchronizing mechanism to move up and down, so that the structure is simple, and the cost is also lowered.

Figure 1:
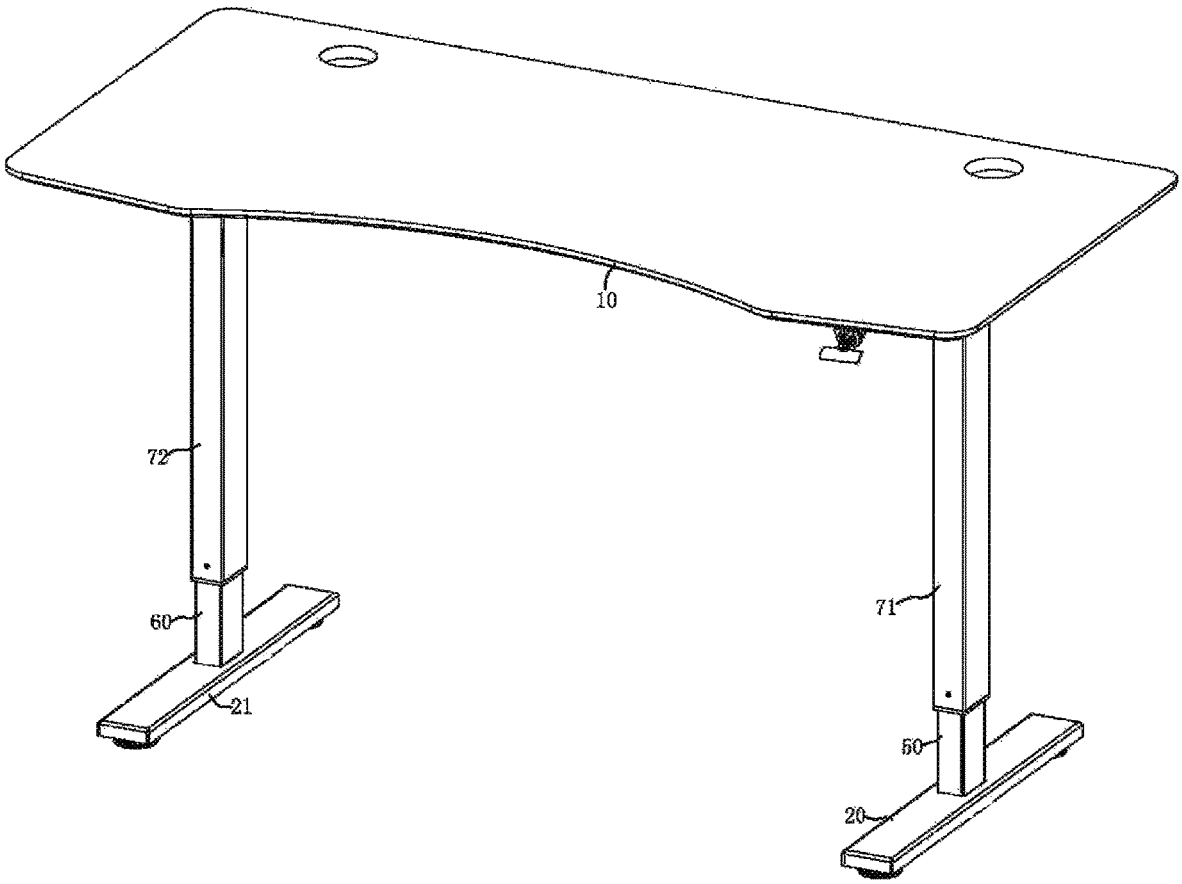
FIG. 1 is a structural diagram of a lifting table of the present invention.

LIST OF REFERENCE NUMERALS IN FIG. 1 TO FIG. 13 tabletop 10;

first support component 20, second support component 21;

linear driver 30, power output portion 31, first connecting base 32, second connecting base 33, first shaft 301, second shaft 311, tooth portion A;

first bracket 40, first bracket body 411, first rotating component 412, second rotating component 413, third rotating component 414;

second bracket 41, second bracket body 421, fourth rotating component 422, fifth rotating component 423, sixth rotating component 424;

first flexible traction component 42;

second flexible traction component 43, rod-shaped component 43*a;* first inner fixed tube 50, first inner tube 50*a*, first connecting piece 51, second connecting piece 52;

second inner fixed tube 60, second inner tube 60*a*, third connecting piece 61, fourth connecting piece 62;

power transfer component 70, side wall 70*a*, bottom wall 70*b*, groove 70*c*, opening 70*d;* first movable outer tube 71, second movable outer tube 72;

locking mechanism 80, first torsion spring 81, one end 81*a*, the other end 81*b*, first sleeve 82, body 83, second fixed seat 83*a*, sheath 84, switch 85, second torsion spring 86, one end 86*a*, the other end 86*b*, second sleeve 87, first enclasping arm 88, second enclasping arm 89, elastic component 90, torsion spring 91, limiting sheet 92, base 93, shaft 94, return spring 95;

unlocking mechanism 100.

DETAILED DESCRIPTION OF THE INVENTION

Figure 2:
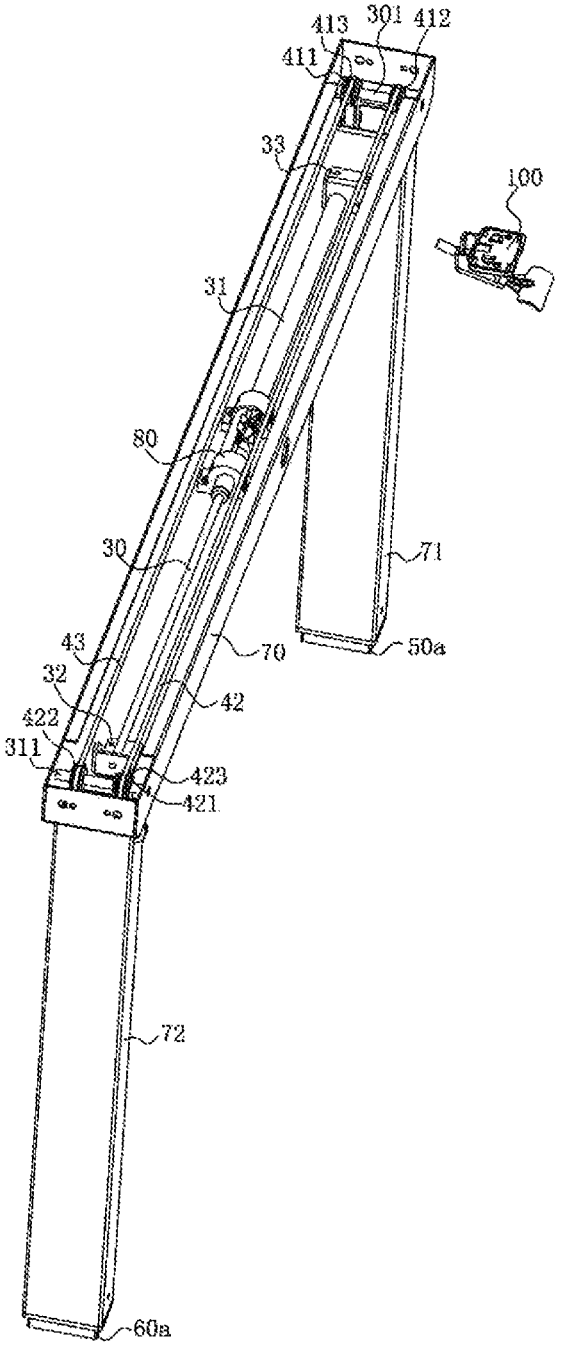
FIG. 2 is a schematic diagram of a first kind of synchronizing lifter of the present invention after a tabletop is hidden on the basis of FIG. 1.

FIG. 1 shows a lifting table. As shown in FIG. 1 and FIG. 2, in one or more embodiments, the table includes a tabletop 10, a first support component 20, a second support component 21 and a synchronizing lifter, wherein the tabletop 10 is mounted at the upper part of the synchronizing lifter, and the first support component 20 and the second support component 21 are respectively connected with the lower part of the synchronizing lifter.

As shown in FIG. 2, the synchronizing lifter includes a first inner fixed tube 50, a second inner fixed tube 60 and a synchronizing mechanism, wherein the synchronizing mechanism includes a first bracket 40, a second bracket 41, a power transfer component 70, a first flexible traction component 42, a second flexible traction component 43, a linear driver 30, a locking mechanism 80 and an unlocking mechanism 100, and all parts and the relationship thereof are described in detail below.

Figure 3:
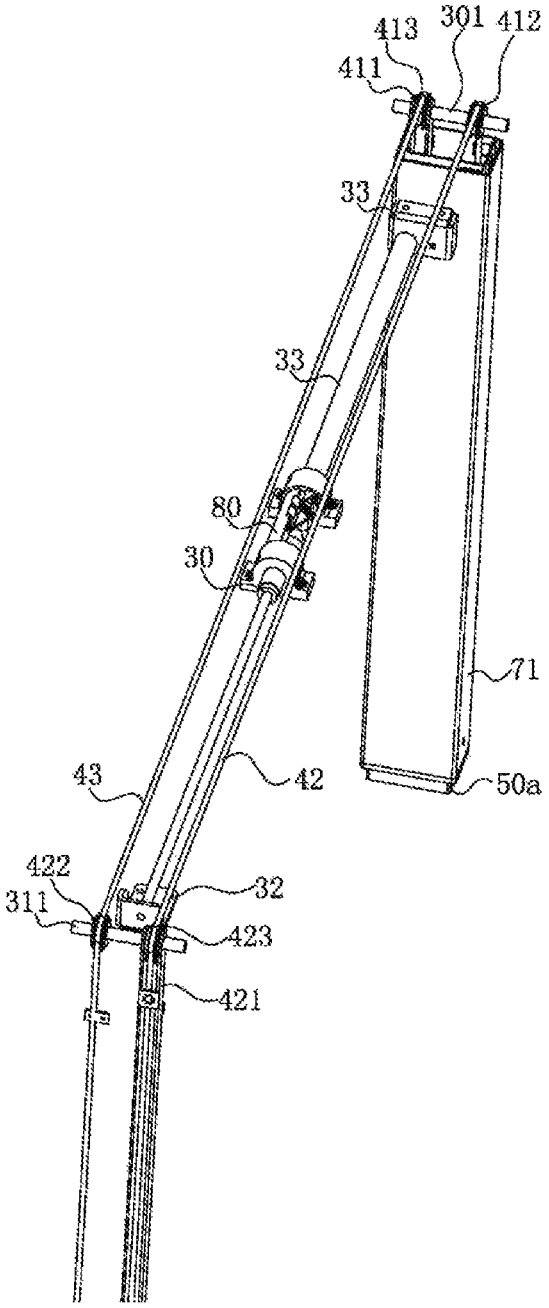
FIG. 3 is a schematic diagram after a second inner fixed tube and a second movable outer tube are hidden on the basis of FIG. 2.
Figure 4:
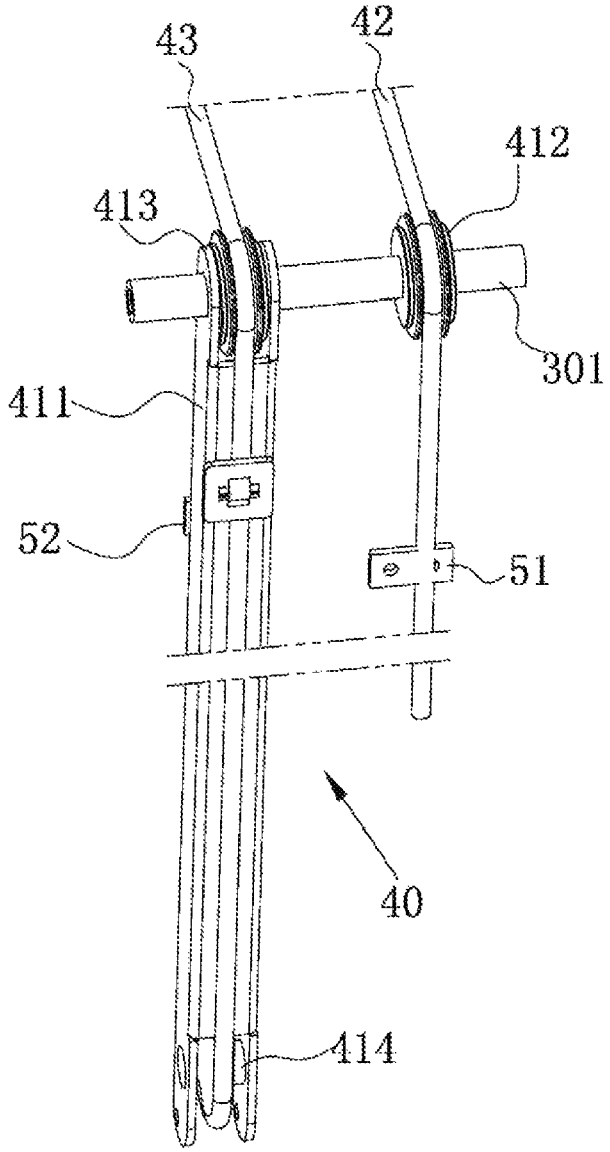
FIG. 4 is an assembly diagram of a first bracket with a first rotating component, a second rotating component and a third rotating component.

As shown in FIG. 2 to FIG. 4, one end of the first bracket 40 is in clearance fit in the first inner fixed tube 50, and the other end of the first bracket 40 is exposed outside the first inner fixed tube 50. The first bracket 40 includes a first bracket body 411, a first rotating component 412, a second rotating component 413 and a third rotating component 414, wherein one end of the first bracket body 411 is in clearance fit in the first inner fixed tube 50, and the other end of the first bracket body 411 is exposed outside the first inner fixed tube 50. The third rotating component 414 is rotationally mounted at one end of the first bracket body 411, the other end of the first bracket body 411 is provided with a first hole, the end part of a first shaft 301 penetrates through the first rotating component 412 and the second rotating component 413, and the two ends of the first shaft 301 penetrate through the first hole and then are connected with the power transfer component 70.

As shown in FIG. 2 to FIG. 4, the cross section of the first bracket body 411 is U-shaped. Preferably, the first bracket body 411 is channel steel, the first rotating component 412 and the second rotating component 413 are both positioned in a groove in one end of the first bracket body 411, and the first shaft 301 penetrates through the first rotating component 412 and the second rotating component 413 to enable the first rotating component 412 and the second rotating component 413 to be supported by the first shaft 301, so that the first rotating component 412 and the second rotating component 413 can rotate. The third rotating component 414 is positioned in a groove in the other end of the first bracket body 411, and the third rotating component 414 is supported by a first mandrel (not shown), so that the third rotating component 414 can rotate. Each of the first rotating component 412, the second rotating component 413 and the third rotating component 414 is one of a bearing, a roller and a chain wheel.

Figure 5:
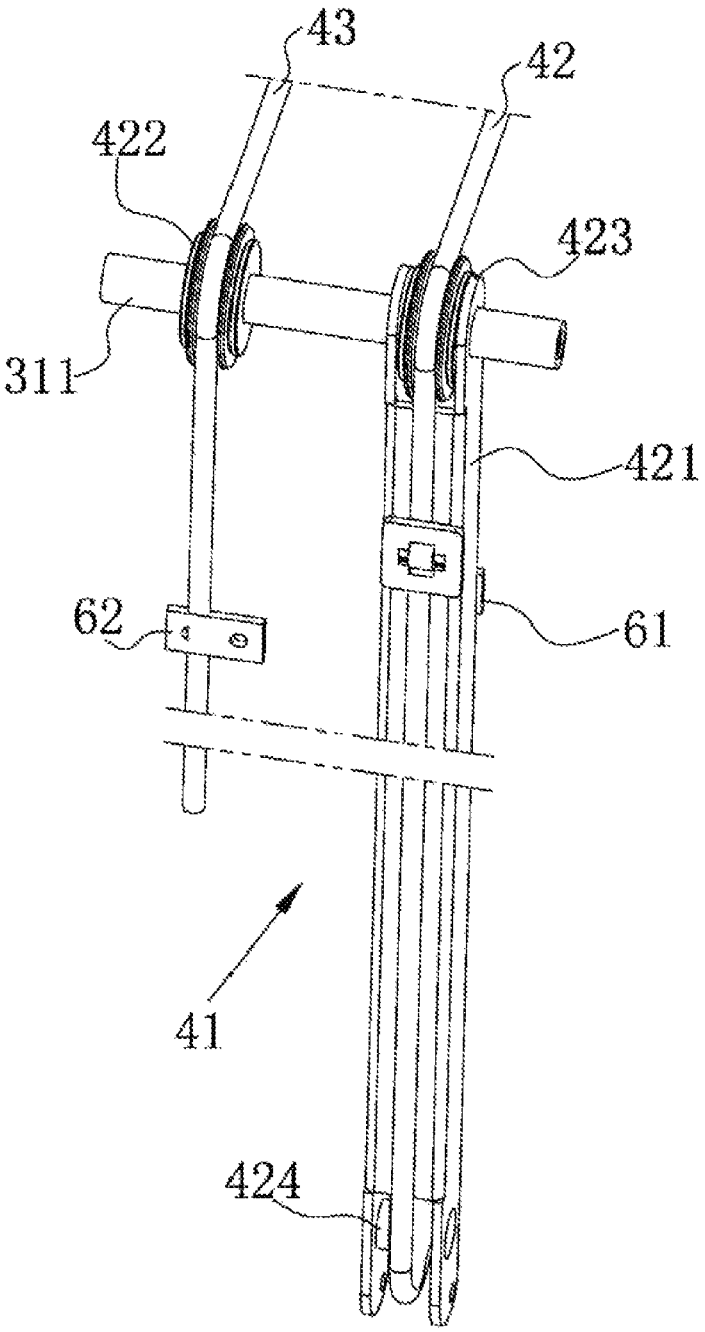
FIG. 5 is an assembly diagram of a second bracket with a fourth rotating component, a fifth rotating component and a sixth rotating component.
Figure 6:
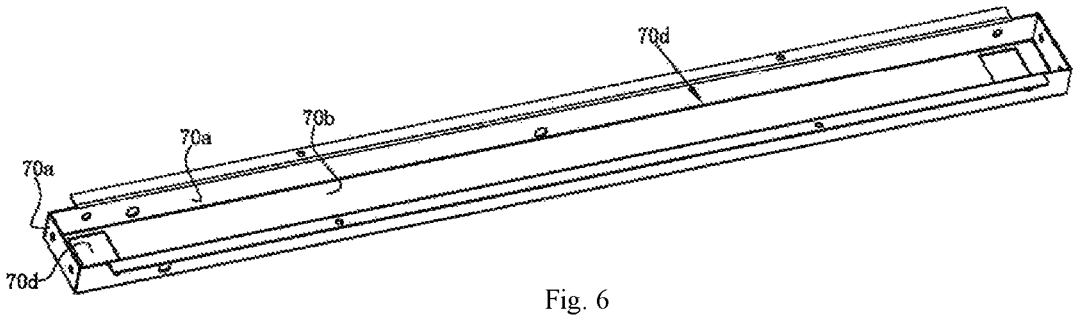
FIG. 6 is a schematic diagram of a power transfer component as shown in FIG. 2.
Figure 7:
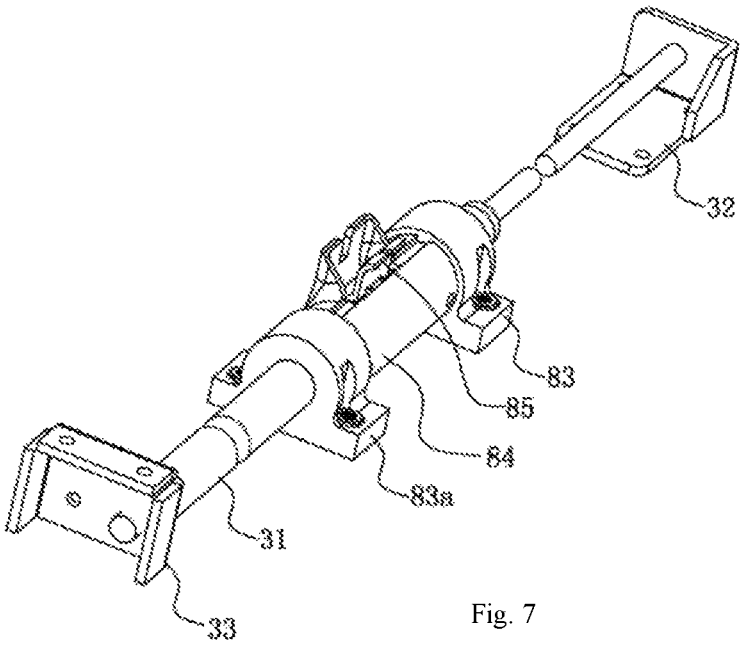
FIG. 7 is an assembly diagram of a first kind of locking mechanism and a linear driver in the present invention.
Figure 8:
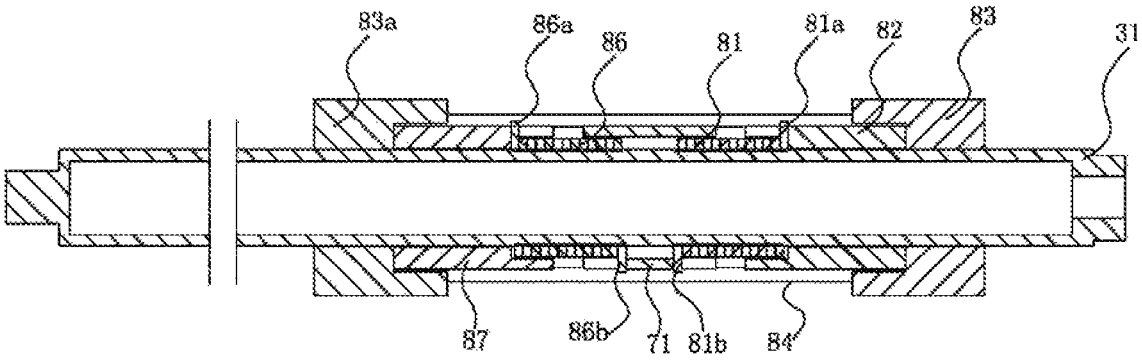
FIG. 8 is a cross-sectional diagram after partial parts are hidden on the basis of FIG. 7.
Figure 9:
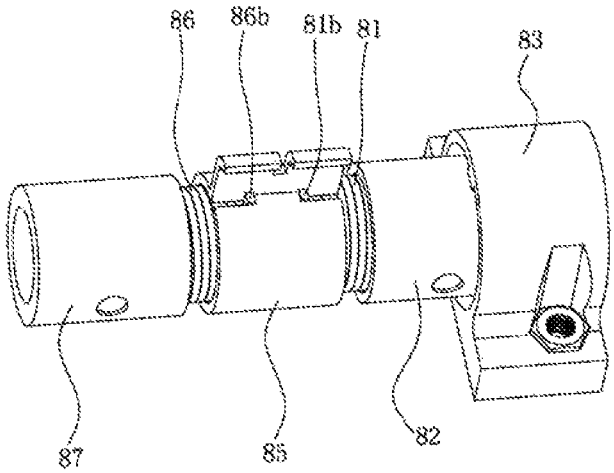
FIG. 9 is a schematic diagram after partial parts in the first kind of locking mechanism are hidden in the present invention.

As shown in FIG. 2 and FIG. 5, one end of the second bracket 41 is in clearance fit in the second inner fixed tube 60, and the other end of the second bracket 41 is exposed outside the second inner fixed tube 60. The second bracket 42 includes a second bracket body 421, a fourth rotating component 422, a fifth rotating component 423 and a sixth rotating component 424, wherein one end of the second bracket body 421 is in clearance fit in the second inner fixed tube 60, and the other end of the second bracket body 421 is exposed outside the second inner fixed tube 60. The sixth rotating component 424 is rotationally mounted at one end of the second bracket body 421. The other end of the second bracket body 421 is provided with a second hole, the end part of a second shaft 311 penetrates through the fourth rotating component 422 and the fifth rotating component 423, and the two ends of the second shaft 311 penetrate through the second hole and then are connected with the power transfer component 70.

As shown in FIG. 2 and FIG. 5, the cross section of the second bracket body 421 is U-shaped. Preferably, the second bracket body 421 is channel steel, the fourth rotating component 422 and the fifth rotating component 423 are positioned in a groove in one end of the second bracket body 421, and the second shaft 311 penetrates through the fourth rotating component 422 and the fifth rotating component 423 to enable the fourth rotating component 422 and the fifth rotating component 423 to be supported by the second shaft 311, so that the fourth rotating component 422 and the fifth rotating component 423 can rotate. The sixth rotating component 424 is positioned in a groove in the other end of the second bracket body 421, and the sixth rotating component 424 is supported by a second mandrel, so that the sixth rotating component 424 can rotate. Each of the fourth rotating component 422, the fifth rotating component 423 and the sixth rotating component 424 is one of a bearing, a roller and a chain wheel.

As shown in FIG. 2 to FIG. 5, one end of the first flexible traction component 42 is fixedly connected with the second inner fixed tube 60, the first flexible traction component 42 is flexibly matched with one end of the second bracket 41, one end of the first bracket 40 and the other end of the first bracket 40, and the other end of the first flexible traction component 42 is fixedly connected with the first inner fixed tube 50. Preferably, the first flexible traction component 42 is flexibly matched with the fifth rotating component 423 and the first rotating component 412, and the flexible matching is similar to a matching mode of a belt and a belt pulley.

As shown in FIG. 2 to FIG. 5, one end of the second flexible traction component 43 is fixedly connected with the first inner fixed tube, the second flexible traction component 42 is flexibly matched with one end of the first bracket 40, one end of the second bracket 41 and the other end of the second bracket 41, and the other end of the second flexible traction component 43 is fixedly connected with the second inner fixed tube. The second flexible traction component is flexibly matched with the second rotating component 413 and the fourth rotating component 422, and the flexible matching is similar to a matching mode of a belt and a belt pulley.

As shown in FIG. 2 to FIG. 5, the first inner fixed tube 50 includes a first inner tube 50*a*, a first connecting piece 51 and a second connecting piece 52, wherein one end of the first inner tube 50*a* is fixed with the first support component 20, and at least a portion of the first connecting piece 51 is positioned in the first inner tube 50*a* and is fixed with the first inner tube 50*a*. The second connecting piece 52 is fixed with the first inner tube 50*a* or the first bracket 411.

As shown in FIG. 2 to FIG. 9, the second inner fixed tube 60 includes a second inner tube 60*a*, a third connecting piece 61 and a fourth connecting piece 62, wherein one end of the second inner tube 60*a* is fixed with the second support component 21, and at least a portion of the third connecting piece 61 is positioned in the second inner tube 60*a* and is fixed with the second inner tube 60*a*. The fourth connecting piece 62 is fixed with the second inner tube 60*a* or the second bracket 421.

As shown in FIG. 2 to FIG. 5, one end of the first flexible traction component 42 is flexibly matched with the sixth rotating component 424 and then fixedly connected with the third connecting piece 61, and the other end of the first flexible traction component 42 is fixedly connected with the first connecting piece 51. One end of the second flexible traction component 43 is flexibly matched with the third rotating component 414 and then is fixedly connected with the second connecting piece 52, and the other end of the second flexible traction component 43 is fixedly connected with the fourth connecting piece 62.

As shown in FIG. 2 to FIG. 5, each of the first flexible traction component 42 and the second flexible traction component 43 is respectively one of a rope-shaped component, a belt-shaped component, a steel wire and a chain. When each of the first flexible traction component 42 and the second flexible traction component 43 adopts a rope-shaped component or a belt-shaped component or a steel wire, each of the first rotating component 412, the second rotating component 413, the third rotating component 414, the fourth rotating component 422, the fifth rotating component 423 and the sixth rotating component 424 adopts a bearing or a roller, and the outer circumferential surfaces of the bearings or the rollers are provided with grooves for adapting to the first flexible traction component 42 and the second flexible traction component 43.

When each of the first flexible traction component 42 and the second flexible traction component 43 adopts a chain, each of the first rotating component 412, the second rotating component 413, the third rotating component 414, the fourth rotating component 422, the fifth rotating component 423 and the sixth rotating component 424 adopts a chain wheel.

As shown in FIG. 2 to FIG. 5, the power transfer component 70 includes a cross beam and a support arm (not shown), the power transfer component 70 is connected with the tabletop 10, the power transfer component 70 is spanned between the first bracket 40 and the second bracket 41, one end of the power transfer component 70 is connected with the other end of the first bracket 40, and the other end of the power transfer component 70 is connected with the other end of the second bracket 41. When the linear driver 30 drives the first flexible traction component 42 or the second flexible traction component 43 or the first bracket 40 or the second bracket 41 to move, for example, when the linear driver 30 drives the first flexible traction component 42 to move, the first bracket 40 moves up, at this time, the first bracket 40 drives one end of the power transfer component 70 connected with the first bracket 40 to move up to enable the whole power transfer component 70 to move up, i.e., the other end of the power transfer component 70 also moves up, at this time, the power transfer component 70 drives the second bracket 41 to move up, and the second bracket 41 drives the second flexible traction component 43 to move. Therefore, because only one linear driver 30 is adopted in the present invention, when the output end of the linear driver 30 has power, the first bracket 40 and the second bracket 41 can move up or down according to the relationship among the power transfer component 70, the first flexible traction component 42, the second flexible traction component 43 and the first bracket 40 as well as the second bracket 41. Obviously, the power transfer component 70 plays a role in power transfer.

As shown in FIG. 2 to FIG. 6, the power transfer component 70 includes side walls 70*a* and a bottom wall 70*b*. Preferably, four side walls 70*a* are adopted, the four side walls 70*a* and the bottom wall 70*b* enclose a groove 70*c*, the two ends of the bottom wall are provided with openings 70*d*, and the two openings 70*d* are respectively used for providing spaces when the first bracket 40, the second bracket 41, the first flexible traction component 42 and the second flexible traction component 43 move. The formed groove 70*c* can contain the first flexible traction component 42 and the second flexible traction component 43, so that the first flexible traction component 42 and the second flexible traction component 43 cannot be seen from the outside.

As shown in FIG. 2 to FIG. 5, the power output portion 31 of the linear driver 30 is connected with one of the first flexible traction component 42, the second flexible traction component 43, the first bracket 411 and the second bracket 421. For the mounting position of the linear driver 30, the following modes can be adopted.

The linear driver 30 is arranged on the power transfer component 70, and the power output portion 31 of the linear driver 30 is connected with the first flexible traction component 42 or the second flexible traction component 43. In the present embodiment, the power output portion 31 of the linear driver 30 is connected with the first flexible traction component 42, and preferably, the linear driver 30 adopts a gas spring which is always in an opened state, therefore, the locking mechanism 80 enclasps the power output portion 31 of the linear driver 30. A piston rod of the gas spring is fixedly provided with a first connecting base 32, the first connecting base 32 is fixedly connected with the power transfer component 70, the power output portion 31 is a cylinder portion of the gas spring, a second connecting base 33 is mounted at one end of the power output portion 31, and the second connecting base is preferentially connected with the first flexible traction component 42. Because the piston rod of the gas spring is fixedly connected with the power transfer component 70 through the first connecting base 32, the piston rod of the gas spring cannot move, but the power output portion 31 can move relative to the piston rod.

Figure 10:
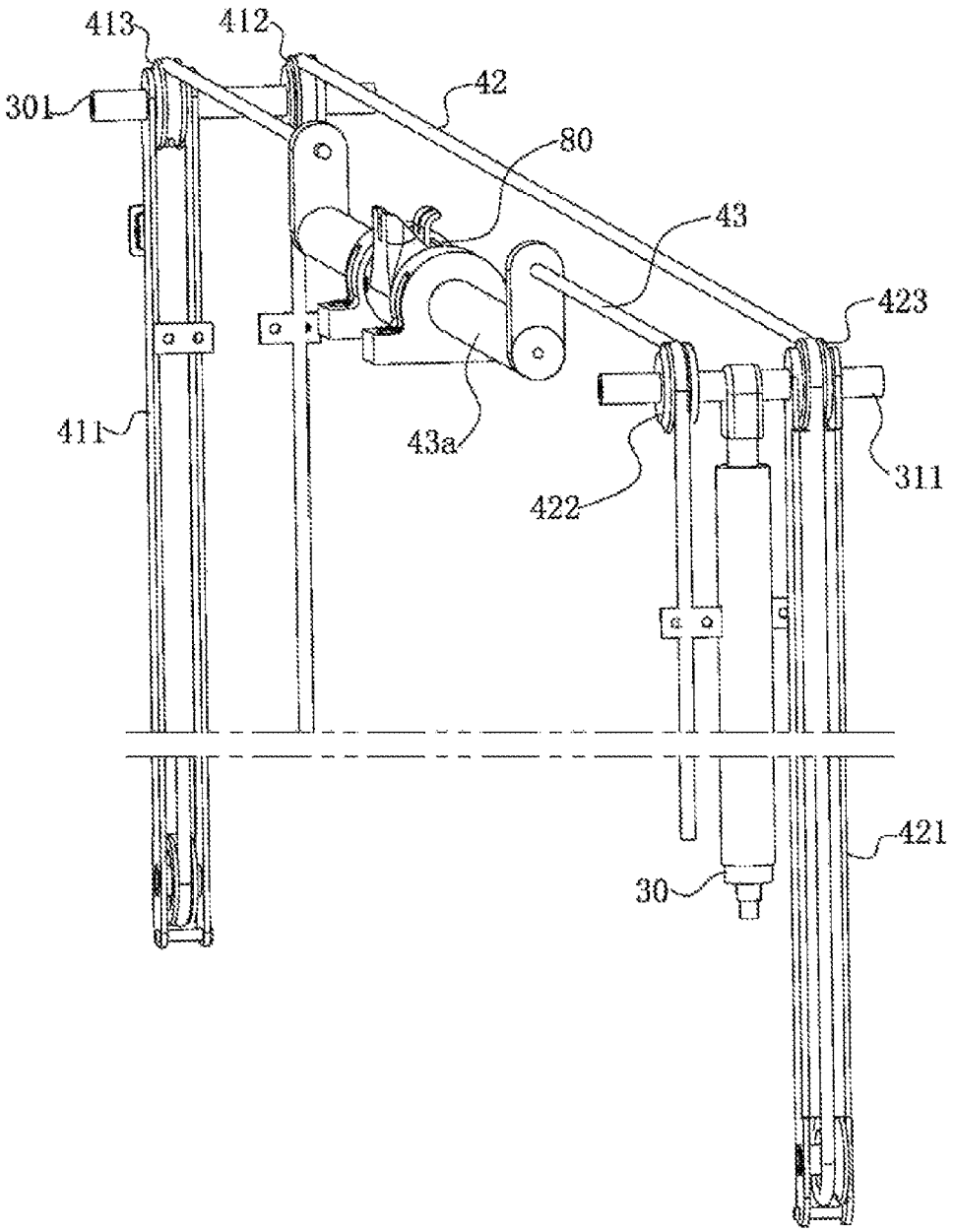
FIG. 10 is a schematic diagram of a second kind of synchronizing lifter in the present invention.

As shown in FIG. 2 to FIG. 9, the power output portion 31 of the linear driver 30 is matched with a locking mechanism 80, the locking mechanism 80 limits the displacement of the power output portion 31 of the linear driver, and the locking mechanism 80 is an enclasping mechanism. The enclasping mechanism includes a first torsion spring 81, a first connecting assembly and a switch 85, wherein the first torsion spring 81 enclasps the linear driver 30 or the first flexible traction component 42 or the second flexible traction component 43. If the enclasping object of the first torsion spring 81 is the linear driver 30, the first torsion spring 81 enclasps the power output portion 31 of the linear driver 30; and if the enclasping object of the first torsion spring 81 is the first flexible traction component 42 or the second flexible traction component 43, a rod-shaped component 43*a* (as shown in FIG. 10) for increasing the contact area is arranged on the first flexible traction component 42 or the second flexible traction component 43, and the first torsion spring 81 enclasps the rod-shaped component.

As shown in FIG. 2 to FIG. 9, one end 81*a* of the first torsion spring 81 is fixed with the first connecting assembly. The first connecting assembly includes a first sleeve 82 and a first fixed seat, wherein the first sleeve 82 sleeves the linear driver 30 or the first flexible traction component 42 or the second flexible traction component 43, one end of the first sleeve 82 is provided with a first opening, and one end 81*a* of the first torsion spring 81 is clamped in the first opening. The first fixed seat is fixedly connected with the first sleeve 82, the first fixed seat 83 is fixedly connected with the power transfer component 70, the first fixed seat includes a body 83 and a sheath 84, the body 83 is fixed with the sheath 84, and the first sleeve 82 is fixed with the sheath 84. The first fixed seat also can only include the body 83, and the body 83 is directly fixed with the first sleeve 82.

As shown in FIG. 2 to FIG. 9, the switch 85 is fixed with the other end 81*b* of the first torsion spring 81; and when the switch 85 rotates, the first torsion spring 81 is twisted, and the diameter of an inner hole of the first torsion spring 81 is increased so as to release the locking of the linear driver 30 or the first flexible traction component 42 or the second flexible traction component 43.

As shown in FIG. 2 to FIG. 9, the enclasping mechanism further includes a second torsion spring 86 and a second connecting assembly, wherein the second torsion spring 86 enclasps the linear driver 30 or the first flexible traction component 42 or the second flexible traction component 43; one end 86*a* of the second torsion spring 86 is fixed with the second connecting assembly; the other end 86*b* of the second torsion spring 86 is fixed with the switch 85; and when the switch 85 rotates, the second torsion spring 86 is twisted, and the diameter of an inner hole of the second torsion spring 86 is increased so as to release the locking of the linear driver 30 or the first flexible traction component 42 or the second flexible traction component 43.

As shown in FIG. 2 to FIG. 9, the second connecting assembly includes a second sleeve 87 and a second fixed seat 83*a*, wherein the second sleeve 87 sleeves the linear driver 30 or the first flexible traction component 42 or the second flexible traction component 43, one end of the second sleeve 87 is provided with a second opening, and one end of the second torsion spring 86 is clamped in the second opening. The second fixed seat 83*a* is fixedly connected with the second sleeve 87, the second fixed seat 83*a* is fixedly connected with the power transfer component 70, and the second fixed seat 83*a* sleeves the sheath 84 and is fixed with the sheath 84.

As shown in FIG. 2 to FIG. 9, the unlocking mechanism 100 drives the locking mechanism 80 to be separated from one of the linear driver 30, the first flexible traction component 42, the second flexible traction component 43, the first bracket 411 and the second bracket 421, and the unlocking mechanism 100 is connected with the locking mechanism 80. The unlocking mechanism 100 includes a pressure plate mechanism and a dragline, wherein the pressure plate mechanism is connected with one end of the dragline, the other end of the pressure plate mechanism is connected with the switch 85, the pressure plate mechanism works to drive the dragline to move, and the dragline drives the switch 85 to rotate so as to drive the first torsion spring 81 and the second torsion spring 86 to twist, thereby releasing the locking of the linear driver 30 or the first flexible traction component 42 or the second flexible traction component 43.

When the linear driver 30 can also adopt a driver such as a cylinder, a hydraulic cylinder, an electric push rod or a hand-operated push rod, the locking mechanism 80 is matched with one of the first flexible traction component 42 and the second flexible traction component 43 so as to limit the displacement of the first flexible traction component 42 or the second flexible traction component 43; or the locking mechanism 80 is matched with one of the first bracket 411 and the second bracket 421 so as to limit the displacement of the first bracket 411 and the second bracket 421.

As shown in FIG. 10, the linear driver 30 can be mounted on the power transfer component 70, and at least a portion of the linear driver 30 can also be arranged in the first inner fixed tube 50. For such a mounting position of the linear driver 30, the power output portion 31 of the linear driver 30 is connected with the first bracket 411 or the power transfer component 70 or the first flexible traction component 42. Or at least a portion of the linear driver 30 is arranged in the second inner fixed tube 60, and the power output portion 31 of the linear driver 30 is connected with the other end of the second bracket 421 or the power transfer component 70 or the second flexible traction component 43. In the present embodiment, the linear driver 30 is arranged on the power transfer component 70, and the power output portion 31 of the linear driver 30 is connected with the first flexible traction component 42.

The present invention is not limited to the above embodiments. The enclasping mechanism can also adopt the following structures.

Figure 11:
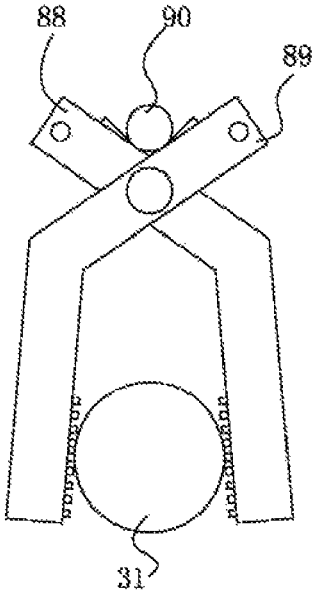
FIG. 11 is an assembly diagram of a second kind of locking mechanism and a linear driver in the present invention.

(a) As shown in FIG. 11, the enclasping mechanism includes a first enclasping arm 88, a second enclasping arm 89 and an elastic component 90, wherein the second enclasping arm 89 is hinged with the middle part of the first enclasping arm 88; one end of the elastic component 90 is connected with the first enclasping arm 88, the other end of the elastic component 90 is connected with one end of the second enclasping arm 89, and the elastic action force generated by the elastic component 90 enables the first enclasping arm 88 and the second enclasping arm 89 to enclasp the linear driver 30 or the first flexible traction component 42 or the second flexible traction component 43; the elastic component 90 preferentially adopts a torsion spring, the first enclasping arm 88 and the second enclasping arm 89 are provided with dragline holes, the dragline in the unlocking mechanism 100 penetrates through the dragline holes, and the unlocking mechanism 100 is connected with the first enclasping arm 88 and the second enclasping arm 89; and when the unlocking mechanism 100 works, one ends of the first enclasping arm 88 and the second enclasping arm 89 move to the inner side so as to overcome the action force of the elastic component 90 to compress the elastic component 90, and the other ends of the first enclasping arm 88 and the second enclasping arm 89 move to the outer side so as to release the enclasping of the linear driver 30 or the first flexible traction component 42 or the second flexible traction component 43.

Figure 12:
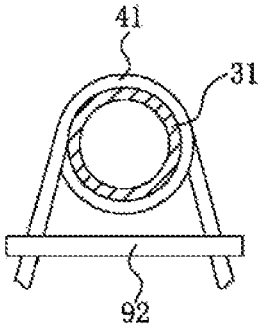
FIG. 12 is an assembly diagram of a third kind of locking mechanism and a linear driver in the present invention.

(b) As shown in FIG. 12, the enclasping mechanism includes a torsion spring 91 enclasping the linear driver 30 or the first flexible traction component 42 or the second flexible traction component 43, and a limiting sheet 92 for enabling an included angle formed between the two ends of the torsion spring 91 to be changed between a first angle and a second angle, wherein the limiting sheet 92 is provided with a first hole and a second hole for the two ends of the torsion spring 91 to move, one end of the torsion spring 91 penetrates through the first hole, the other end of the torsion spring 91 penetrates through the second hole, the outer diameter of one end of the torsion spring 91 is less than the width of the first hole, and the outer diameter of the other end of the torsion spring 91 is less than the width of the second hole, so that the two ends of the torsion spring 91 can respectively move in the first hole and the second hole. The diameter of an inner hole of the torsion spring 91 is less than the outer diameter of the linear driver 30 or the first flexible traction component 42 or the second flexible traction component 43 penetrating through the torsion spring 91, and the linear driver 30 or the first flexible traction component 42 or the second flexible traction component 43 penetrates through the torsion spring 91, so that the linear driver 30 or the first flexible traction component 42 or the second flexible traction component 43 is enclasped by the torsion spring 91. One end of the torsion spring 91 is fixed with the power transfer component 70, and the other end of the torsion spring 91 is connected with the unlocking mechanism 100. When the unlocking mechanism 100 works, one end of the torsion spring 91 is driven to move so as to enable the torsion spring 91 to twist, and the inner diameter of the torsion spring 91 is increased, thereby releasing the locking of the linear driver 30 or the first flexible traction component 42 or the second flexible traction component 43.

Figure 13:
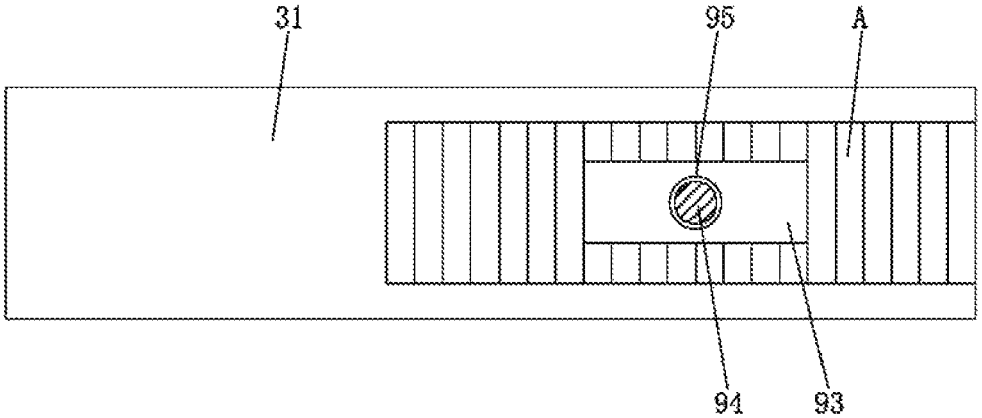
FIG. 13 is an assembly diagram of a fourth kind of locking mechanism and a linear driver in the present invention.

(c) As shown in FIG. 13, the locking mechanism is a tooth meshing mechanism, and one of the linear driver 30, the first flexible traction component 42, the second flexible traction component 43, the first bracket 421 and the second bracket 422 is provided with a tooth portion A matched with the tooth meshing mechanism. The tooth meshing mechanism includes a base 93, a shaft 94 and a return spring 95, wherein one end of the base 93 is provided with teeth meshed with the tooth portion A, the other end of the base 93 is connected with one end of the shaft 94, and the other end of the shaft 94 is connected with the unlocking mechanism 100. In the present embodiment, the tooth meshing mechanism is mounted in the power transfer component 70, the side wall 70*a* of the power transfer component 70 is provided with a shaft hole, the other end of the shaft 94 penetrates through the shaft hole in the side wall 70*a* and then is connected with the dragline in the unlocking mechanism 100, the spring 95 sleeves the shaft 94, one end of the spring 95 abuts against the base 93, and the other end of the spring 95 abuts against the side wall 70*a*. The power transfer component 70 is provided with a guide rail, and the base 93 is matched with the sliding guide rail so as to prevent the base 93 from moving to the lateral direction of the guide rail. In an unlocked state, the teeth on the base 93 are meshed with the tooth portion A by the action force generated by the spring 95, so that the linear driver 30 cannot move. When unlocking is required, the unlocking mechanism 100 enables the base 93 to move by the shaft 94 so as to release the meshing action between the teeth and the tooth portion A. When the base 93 moves, the return spring 95 is compressed; and when the synchronizing lifter moves to the required position, the unlocking mechanism 100 is released, the base 93 returns under the action of the return spring 95, and the teeth on the base 93 are meshed with the tooth portion again. The tooth meshing mechanism can be mounted on the power transfer component 70 so as to lock the linear driver 30 positioned in the power transfer component 70, and the tooth meshing mechanism can also be mounted in the first inner fixed tube 50 or the second inner fixed tube 60 so as to lock the first bracket body 411 or the second bracket body 421.

As shown in FIG. 2 to FIG. 6, a first movable outer tube 71 is also arranged, one end of the first movable outer tube 71 is fixed with one end of the power transfer component 70, and the first movable outer tube 71 moves up and down with the ascending and descending of the power transfer component 70. The first movable outer tube 71 sleeves the first inner fixed tube 50, i.e., the first movable outer tube 71 sleeves the first inner tube 50*a*. A first sliding guide assembly (not shown) is arranged between the first movable outer tube 71 and the first inner tube 50*a*. Preferably, a first sliding guide assembly is mounted on the first inner tube 50*a*, the first sliding guide assembly is fixed on the outer circumferential surface of the other end of the first inner tube 50*a*, and the first sliding guide assembly is matched with the inner wall surface of the first movable outer tube 71 so as to guide the first movable outer tube 71 to move up and down. The structure of the first sliding guide assembly is the same as that of a rolling friction assembly disclosed in the patent CN106308039A, and is not described herein.

As shown in FIG. 2 to FIG. 11, a second movable outer tube 72 is also arranged, one end of the second movable outer tube 72 is fixed with the other end of the power transfer component 70, and the second movable outer tube 72 moves up and down with the ascending and descending of the power transfer component 70. The second movable outer tube 72 sleeves the second inner fixed tube 60, i.e., the second movable outer tube 72 sleeves the second inner tube

60*a*. A second sliding guide assembly is arranged between the first movable outer tube 71 and the first inner tube 50*a*. Preferably, the second sliding guide assembly is fixed on the outer circumferential surface of the other end of the second inner tube 60*a*, and the second sliding guide assembly is matched with the inner wall surface of the second movable outer tube 72 so as to guide the second movable outer tube 72 to move up and down. The structure of the second sliding guide assembly is the same as that of the first sliding guide assembly, and is not described herein.

As shown in FIG. 2 to FIG. 13, when the first bracket 40 and the second bracket 41 move up and down, because the first movable outer tube 71 shields the first bracket 40 and the second movable outer tube 72 shields the second bracket 41, the first bracket 40 and the second bracket 41 can be prevented from being exposed to the outside to avoid the influence on the aesthetic appearance.

The upper, lower, left and right directions involved in the working processes of the present invention are all observed from the positions in the drawings, and do not limit the claims.

Ascending process: after the unlocking mechanism 100 releases the locking of the linear driver 30, the linear driver 30 works, the power output portion 31 of the linear driver 30 extends out to drive the first flexible traction component 42 to move leftwards, the power of the first flexible traction component 42 acts on the first bracket body 411 to enable the first bracket body 411 to move up, the first bracket body 411 drives one end of the power transfer component 70 to move up to enable the whole power transfer component 70 to move up, i.e., the other end of the power transfer component 70 moves up, then the power transfer component 70 drives the second bracket body 421 to move up, and the second bracket body 421 drives the second flexible traction component 43 to move rightwards.

Descending process: the power output portion 31 of the linear driver 30 retracts, one end of the first flexible traction component 42 is fixed with a third connecting piece 61 to force the flexibly matched portion of the first flexible traction component 42 and the second bracket body 421 to move rightwards, the power of the first flexible traction component 42 acts on the first bracket body 411 to enable the first bracket body 411 to move down, the first bracket body 411 drives one end of the power transfer component 70 to move down to enable the whole power transfer component 70 to move down, i.e., the other end of the power transfer component 70 also moves down, then the power transfer component 70 drives the second bracket body 421 to move down, and the second bracket body 421 drives the second flexible traction component 43 to move leftwards.

The present invention is not limited to the above embodiments. For example, two ends of both the first bracket 40 and the second bracket 41 are arc-shaped, and the first flexible traction component 42 and the second flexible traction component 43 are respectively matched with the upper end parts of the first bracket and the second bracket. In this mode, a first rotating component 412, a second rotating component 413 and a third rotating component 414 are not required to be mounted on the first bracket 40, and a fourth rotating component 422, a fifth rotating component 423 and a sixth rotating component 424 are not required to be mounted on the second bracket 41. By adopting such a mode, when each of the first flexible traction component 42 and the second flexible traction component 43 adopts a belt-shaped component or a rope-shaped component, surface contact is formed between the first flexible traction component 42 and the first bracket 40 as well as the second bracket 41; and when the first flexible traction component 42 moves, friction force between surfaces is formed between the first flexible traction component 42 as well as the second flexible traction component 43 and the first bracket 40 as well as the second bracket 41. When each of the first flexible traction component 42 and the second flexible traction component 43 adopts a steel wire, line and surface contact is formed between the first flexible traction component 42 and the first bracket 40 as well as the second bracket 41; and when the first flexible traction component 42 moves, friction force between lines and surfaces is formed between the first flexible traction component 42 as well as the second flexible traction component 43 and the first bracket 40 as well as the second bracket 41. In this mode, regardless of whether each of the first flexible traction component 42 and the second flexible traction component 43 adopts a belt-shaped component or a rope-shaped component or a steel wire, the friction force between the first flexible traction component 42 as well as the second flexible traction component 43 during moving and the first bracket 40 as well as the second bracket 41 is greater than the friction force in the first embodiment, therefore, in actual use, it is preferable to adopt a structure in which the rotating components are arranged at the end parts of the brackets.

In addition, the first bracket body 411 and the second bracket body 421 can also be connected with the power transfer component 70 in a welding mode.

What is claimed is:

1. A synchronizing lifter, comprising: a first inner fixed tube and a second inner fixed tube and further comprising a synchronizing mechanism, wherein the synchronizing mechanism comprises a first bracket with one end being in clearance fit in the first inner fixed tube and a second bracket with one end being in clearance fit in the second inner fixed tube; a power transfer component spanned between the first bracket and the second bracket, wherein one end of the power transfer component is connected with the other end of the first bracket, and the other end of the power transfer component is connected with the other end of the second bracket; a first flexible traction component, wherein one end of the first flexible traction component is connected with the second inner fixed tube, the first flexible traction component is flexibly matched with one end of the second bracket, one end of the first bracket and the other end of the first bracket, and the other end of the first flexible traction component is connected with the first inner fixed tube; a second flexible traction component, wherein one end of the second flexible traction component is connected with the first inner fixed tube, the second flexible traction component is flexibly matched with one end of the first bracket, one end of the second bracket and the other end of the second bracket, and the other end of the second flexible traction component is connected with the second inner fixed tube; a linear driver, wherein a power output portion of the linear driver is connected with one of the first flexible traction component, the second flexible traction component, the first bracket and the second bracket; a locking mechanism, wherein the locking mechanism is matched with the power output portion of the linear driver so as to limit the displacement of the output portion of the linear driver; or the locking mechanism is matched with one of the first flexible traction component and the second flexible traction component so as to limit the displacement of the first flexible traction component or the second flexible traction component; or the locking mechanism is matched with one of the first bracket and the second bracket so as to limit the displacement of the first bracket and the second bracket; and an unlocking mechanism for driving the locking mechanism to be separated from one of the linear driver, the first flexible traction component, the second flexible traction component, the first bracket and the second bracket, and the unlocking mechanism is connected with the locking mechanism, wherein the linear driver is a gas spring maintaining an opened state.

2. The synchronizing lifter according to claim 1, wherein the locking mechanism is an enclasping mechanism.

3. The synchronizing lifter according to claim 2, wherein the enclasping mechanism comprises: a first torsion spring enclasping the linear driver or the first flexible traction component or the second flexible traction component; a first connecting assembly, wherein one end of the first torsion spring is fixed with the first connecting assembly; and a switch fixed with the other end of the first torsion spring, wherein when the switch rotates, the first torsion spring is twisted, and the diameter of an inner hole of the first torsion spring is increased so as to release the locking of the linear driver or the first flexible traction component or the second flexible traction component.

4. The synchronizing lifter according to claim 3, wherein the enclasping mechanism further comprises: a second torsion spring enclasping the linear driver or the first flexible traction component or the second flexible traction component; a second connecting assembly, wherein one end of the second torsion spring is fixed with the second connecting assembly; and the other end of the second torsion spring is fixed with the switch, wherein when the switch rotates, the second torsion spring is twisted, and the diameter of an inner hole of the second torsion spring is increased so as to release the locking of the linear driver or the first flexible traction component or the second flexible traction component.

5. The synchronizing lifter according to claim 3, wherein the first connecting assembly comprises: a first sleeve sleeving the linear driver or the first flexible traction component or the second flexible traction component; and a first fixed seat, the first fixed seat being fixedly connected with the first sleeve.

6. The synchronizing lifter according to claim 2, wherein the enclasping mechanism comprises: a first enclasping arm; a second enclasping arm, the second enclasping arm being hinged with the middle part of the first enclasping arm; and an elastic component, wherein one end of the elastic component is connected with the first enclasping arm, the other end of the elastic component is connected with one end of the second enclasping arm, and the elastic action force generated by the elastic component enables the first enclasping arm and the second enclasping arm to enclasp the linear driver or the first flexible traction component or the second flexible traction component.

7. The synchronizing lifter according to claim 2, wherein the enclasping mechanism comprises: a torsion spring enclasping the linear driver or the first flexible traction component or the second flexible traction component; and a limiting sheet for enabling an included angle formed between the two ends of the torsion spring to be changed between a first angle and a second angle, wherein the limiting sheet is provided with a first hole and a second hole for the two ends of the torsion spring to move, one end of the torsion spring penetrates through the first hole, and the other end of the torsion spring penetrates through the second hole.

8. The synchronizing lifter according to claim 1, wherein the locking mechanism is a tooth meshing mechanism, and one of the linear driver, the first flexible traction component, the second flexible traction component, the first bracket and the second bracket is provided with a tooth portion matched with the tooth meshing mechanism.

9. A lifting table, comprising: a tabletop and a synchronizing lifter, the synchronizing lifter including a first inner fixed tube and a second inner fixed tube and further comprising a synchronizing mechanism, wherein the synchronizing mechanism comprises a first bracket with one end being in clearance fit in the first inner fixed tube and a second bracket with one end being in clearance fit in the second inner fixed tube, a power transfer component spanned between the first bracket and the second bracket, wherein one end of the power transfer component is connected with the other end of the first bracket, and the other end of the power transfer component is connected with the other end of the second bracket, a first flexible traction component, wherein one end of the first flexible traction component is connected with the second inner fixed tube, the first flexible traction component is flexibly matched with one end of the second bracket, one end of the first bracket and the other end of the first bracket, and the other end of the first flexible traction component is connected with the first inner fixed tube, a second flexible traction component, wherein one end of the second flexible traction component is connected with the first inner fixed tube, the second flexible traction component is flexibly matched with one end of the first bracket, one end of the second bracket and the other end of the second bracket, and the other end of the second flexible traction component is connected with the second inner fixed tube, a linear driver, wherein a power output portion of the linear driver is connected with one of the first flexible traction component, the second flexible traction component, the first bracket and the second bracket, a locking mechanism, wherein the locking mechanism is matched with the power output portion of the linear driver so as to limit the displacement of the output portion of the linear driver; or the locking mechanism is matched with one of the first flexible traction component and the second flexible traction component so as to limit the displacement of the first flexible traction component or the second flexible traction component or the locking mechanism is matched with one of the first bracket and the second bracket so as to limit the displacement of the first bracket and the second bracket, and an unlocking mechanism for driving the locking mechanism to be separated from one of the linear driver, the first flexible traction component, the second flexible traction component, the first bracket and the second bracket, and the unlocking mechanism is connected with the locking mechanism, wherein the linear driver is a gas spring maintaining an opened state.

10. The synchronizing lifter according to claim 9, wherein the locking mechanism is an enclasping mechanism.

11. The synchronizing lifter according to claim 10, wherein the enclasping mechanism comprises: a first torsion spring enclasping the linear driver or the first flexible traction component or the second flexible traction component; a first connecting assembly, wherein one end of the first torsion spring is fixed with the first connecting assembly; and a switch fixed with the other end of the first torsion spring, wherein when the switch rotates, the first torsion spring is twisted, and the diameter of an inner hole of the first torsion spring is increased so as to release the locking of the linear driver or the first flexible traction component or the second flexible traction component.

12. The synchronizing lifter according to claim 11, wherein the enclasping mechanism further comprises: a second torsion spring enclasping the linear driver or the first flexible traction component or the second flexible traction component; a second connecting assembly, wherein one end of the second torsion spring is fixed with the second connecting assembly; and the other end of the second torsion spring is fixed with the switch, wherein when the switch rotates, the second torsion spring is twisted, and the diameter of an inner hole of the second torsion spring is increased so as to release the locking of the linear driver or the first flexible traction component or the second flexible traction component.

13. The synchronizing lifter according to claim 11, wherein the first connecting assembly comprises: a first sleeve sleeving the linear driver or the first flexible traction component or the second flexible traction component; and a first fixed seat, the first fixed seat being fixedly connected with the first sleeve.

14. The synchronizing lifter according to claim 10, wherein the enclasping mechanism comprises: a first enclasping arm; a second enclasping arm, the second enclasping arm being hinged with the middle part of the first enclasping arm; and an elastic component, wherein one end of the elastic component is connected with the first enclasping arm, the other end of the elastic component is connected with one end of the second enclasping arm, and the elastic action force generated by the elastic component enables the first enclasping arm and the second enclasping arm to enclasp the linear driver or the first flexible traction component or the second flexible traction component.

15. The synchronizing lifter according to claim 10, wherein the enclasping mechanism comprises: a torsion spring enclasping the linear driver or the first flexible traction component or the second flexible traction component; and a limiting sheet for enabling an included angle formed between the two ends of the torsion spring to be changed between a first angle and a second angle, wherein the limiting sheet is provided with a first hole and a second hole for the two ends of the torsion spring to move, one end of the torsion spring penetrates through the first hole, and the other end of the torsion spring penetrates through the second hole.

16. The synchronizing lifter according to claim 9, wherein the locking mechanism is a tooth meshing mechanism, and one of the linear driver, the first flexible traction component, the second flexible traction component, the first bracket and the second bracket is provided with a tooth portion matched with the tooth meshing mechanism.

* * * * *